US007194808B2

(12) United States Patent
Yeh

(10) Patent No.: US 7,194,808 B2
(45) **Date of Patent: *Mar. 27, 2007**

(54) HAIRDRESSING SCISSORS

(76) Inventor: Wen-Ya Yeh, Suite 2, 15th F, No. 18, Chongxue Rd., Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/162,843

(22) Filed: Sep. 26, 2005

(65) Prior Publication Data

US 2006/0005396 A1 Jan. 12, 2006

Related U.S. Application Data

(63) Continuation of application No. 10/601,369, filed on Jun. 23, 2003, now Pat. No. 6,990,739.

(51) Int. Cl.
*B26B 13/00* (2006.01)

(52) U.S. Cl. ..... 30/226; 30/254

(58) Field of Classification Search ..... 30/145–147, 30/194–197, 226, 227, 229, 254, 260; D8/5, D8/57

See application file for complete search history.

(56) References Cited

U.S. PATENT DOCUMENTS

| | | | | |
|---|---|---|---|---|
| 184,914 | A | 11/1876 | Scripps | 30/226 |
| 550,483 | A | 11/1895 | Carrier | 30/226 X |
| 1,012,918 | A | 12/1911 | Roelants et al. | 30/227 |
| 1,715,898 | A | 6/1929 | Carri | 30/227 |
| 2,272,580 | A | 2/1942 | Phillips | 30/195 |
| 2,456,858 | A | 12/1948 | Bolling | 30/143 |
| 2,840,905 | A | 7/1958 | Geiger | 30/226 |
| 2,853,780 | A | 9/1958 | Bull | 30/327 |
| 3,391,690 | A | 7/1968 | Armao | 30/140 X |
| 4,317,284 | A | 3/1982 | Prindle | 30/147 X |
| D267,996 | S | 2/1983 | Kowalski | 30/226 X |
| 5,600,891 | A | 2/1997 | Orgal | 30/226 |
| 5,875,553 | A | 3/1999 | Geib, Jr. et al. | 30/226 |
| 5,996,592 | A | 12/1999 | Choy | 30/226 X |
| 6,192,590 | B1 | 2/2001 | Yeh | 30/226 |
| 6,434,833 | B1 | 8/2002 | Yeh | 30/226 |
| 6,557,263 | B1 | 5/2003 | Yeh | 30/226 |
| 6,601,304 | B2 | 8/2003 | Yeh | 30/226 |
| 6,634,106 | B2 | 10/2003 | Yeh | 30/226 |
| 6,748,662 | B2 | 6/2004 | Yeh | 30/226 |
| 6,990,739 | B2 * | 1/2006 | Yeh | 30/226 |
| 2004/0255469 | A1 | 12/2004 | Yeh | 30/226 |

FOREIGN PATENT DOCUMENTS

| | | |
|---|---|---|
| DE | 3830934 | 3/1990 |
| JP | 51-128084 | 11/1976 |
| JP | 10-24178 | 1/1998 |
| JP | 2004-41282 | 2/2004 |

* cited by examiner

*Primary Examiner*—Clark F. Dexter
(74) *Attorney, Agent, or Firm*—Alan D. Kamrath; Nikolai & Mersereau, P.A.

(57) ABSTRACT

A pair of hairdressing scissors includes two cutting members pivotally connected together. Each cutting member includes a handle having a first side in which a first groove is defined and a second side in which a second groove is defined. A magnetic member is mounted in each first groove in a manner that the magnetic member has an exposed portion outside the respective handle. The exposed portion of each magnetic member of the pair of hairdressing scissors is adapted to be securely engaged with a second groove of a respective handle of another pair of similarly constructed hairdressing scissors. In another embodiment, each cutting member includes a handle having a through-hole extending from a first side thereof through a second side thereof, and a magnetic member is mounted in each through-hole.

12 Claims, 8 Drawing Sheets

HAIRDRESSING SCISSORS

CROSS REFERENCE TO RELATED APPLICATION

This is a continuation application of U.S. patent application Ser. No. 10/601,369 filed Jun. 23, 2003, now U.S. Pat. No. 6,990,739.

BACKGROUND OF THE INVENTION

1. Field of the Invention

The present invention relates to a pair of hairdressing scissors that can be releasably connected with another pair of hairdressing scissors by magnetic members.

2. Description of the Related Art

A pair of hairdressing scissors that can be releasably connected to another pair of hairdressing scissors has been disclosed in, e.g., U.S. Pat. Nos. 6,192,590; 6,434,833; and 6,557,263. These patents disclose mechanical engagement for connecting two pairs of hairdressing scissors. The present invention is intended to provide a different design using magnetic members to connect two pairs of hairdressing scissors together.

SUMMARY OF THE INVENTION

An object of the present invention is to provide a pair of hairdressing scissors that can be releasably connected with another pair of hairdressing scissors by magnetic members.

In accordance with a first aspect of the invention, a pair of hairdressing scissors includes two cutting members pivotally connected together. Each cutting member includes a handle having a first side and a second side. A first groove is defined in the first side of each handle, and a second groove is defined in the second side of each handle. A magnetic member is mounted in each first groove in a manner that the magnetic member has an exposed portion outside the respective handle. The exposed portion of each magnetic member of the pair of hairdressing scissors is adapted to be securely engaged with a second groove of a respective handle of a pair of similarly constructed hairdressing scissors.

A frame ring may be mounted between each magnetic member and a periphery delimiting the respective first groove. In an embodiment of the invention, each magnetic member has a thickness equal to a sum of a depth of the respective first groove and a depth of the respective second groove. In another embodiment of the invention, each magnetic member has a thickness greater than a sum of a depth of the respective first groove and a depth of the respective second groove.

In accordance with a second aspect of the invention, a pair of hairdressing scissors comprises two cutting members pivotally connected together. Each cutting member includes a handle having a through-hole extending from a first side thereof through a second side thereof. A magnetic member is mounted in each through-hole. The magnetic members of the pair of hairdressing scissors are adapted to attract magnetic members of a pair of similarly constructed hairdressing scissors, thereby connecting the pair of hairdressing scissors and the pair of similarly constructed hairdressing scissors together.

A frame ring may be mounted between each magnetic member and a periphery delimiting the through-hole. Each magnetic member has a thickness equal to or greater than a depth of the respective through-hole.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
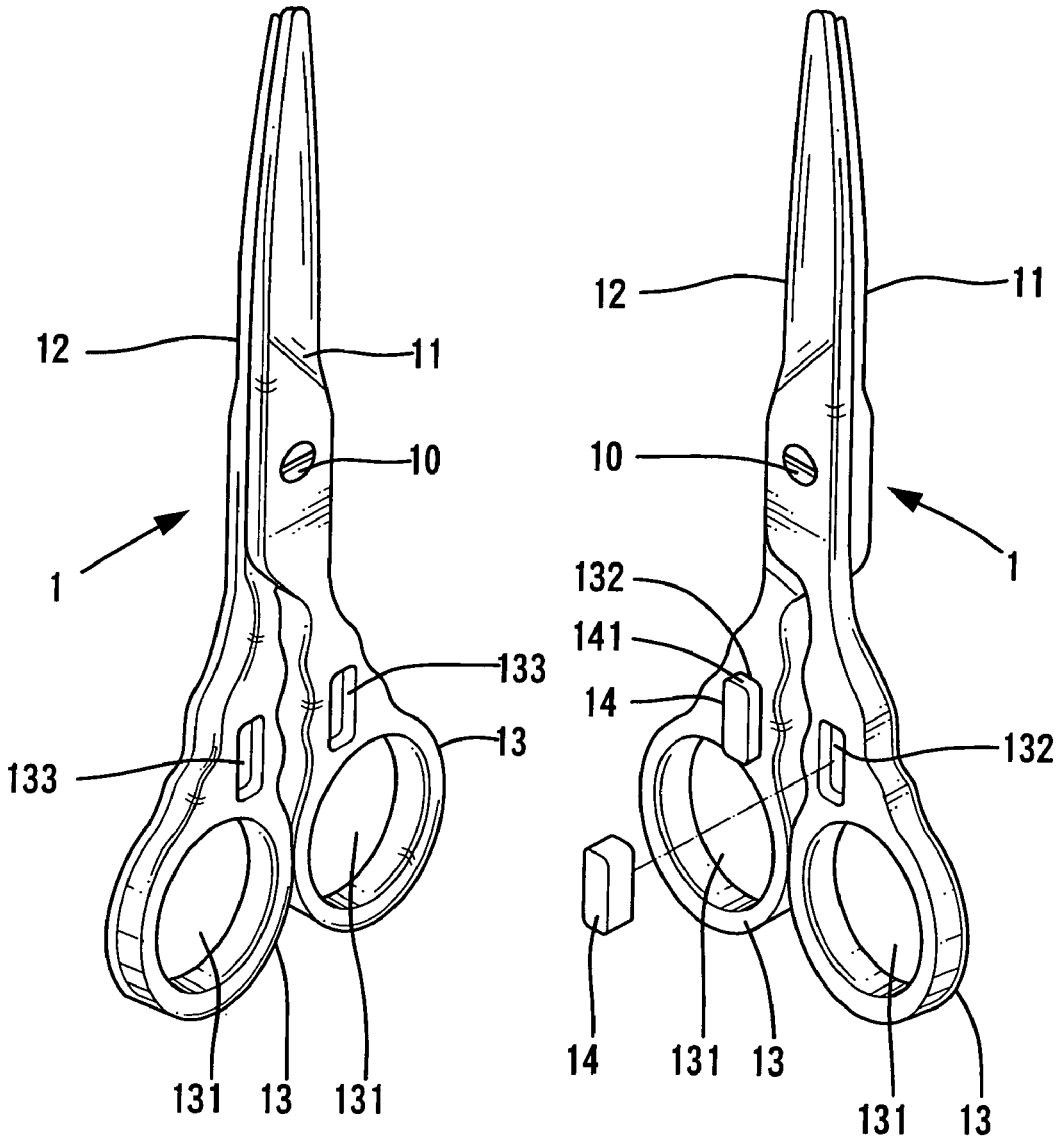
FIG. 1 is a perspective view of two pairs of hairdressing scissors in accordance with a first embodiment of the present invention.

Referring to FIG. 1, a pair of hairdressing scissors 1 in accordance with the present invention generally comprises two cutting members 11 and 12 that are pivoted together by a pivot 10. Each cutting member 11, 12 includes a handle 13 on an end thereof and a blade (not labeled) on the other end thereof, with each handle 13 having an opening 131 for the thumb or index finger of the user.

Figure 2:
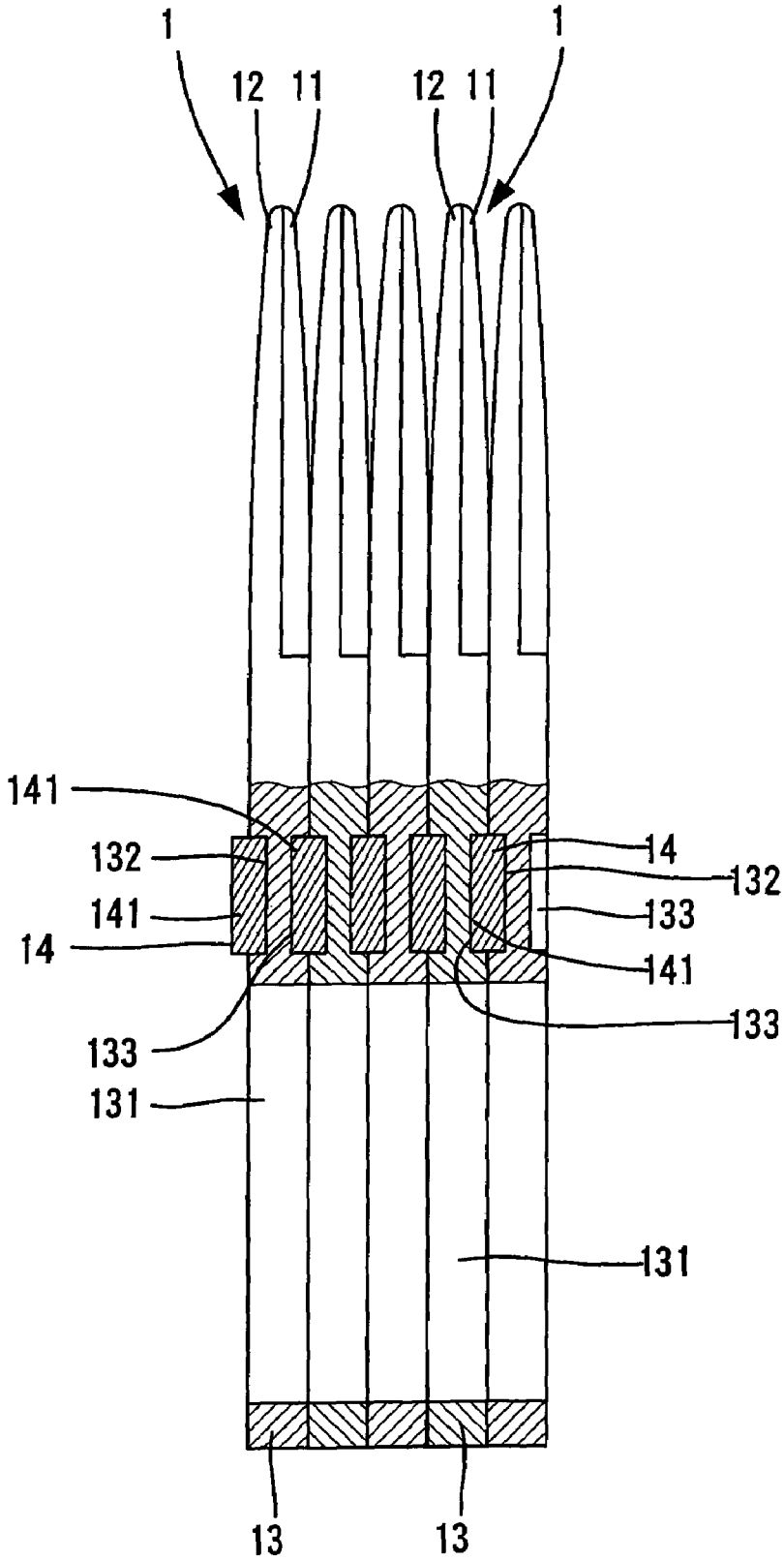
FIG. 2 is a side view, partly sectioned, of plural pairs of hairdressing scissors in accordance with the first embodiment of the present invention.

Each handle 13 has a first groove 132 in a first side thereof and a second groove 133 in a second side thereof. Preferably, the first groove 132 has a depth equal to that of the second groove 133. A magnetic member 14 is mounted in the respective first groove 132, with a portion of the magnetic member 14 being exposed outside the handle 13 (see the exposed portion 141 in FIG. 1). In this embodiment, the respective magnetic member 14 has a thickness twice as a depth of the groove 132 or 133. Alternatively, the respective magnetic member 14 has a thickness that is the sum of the depth of the first groove 132 and the depth of the second groove 133 in a case that the depth of the second groove 133 differs from that of the first groove 132. Thus, the exposed portion 141 of the respective magnetic member 14 of a pair of hairdressing scissors 1 is fittingly received in the respective second groove 133 of another pair of hairdressing scissors 1, thereby connecting the two pairs of hairdressing scissors 1 together. By repeating this connecting operation, plural pairs of hairdressing scissors 1 can be connected together, as shown in FIG. 2. Since the cutting members 11 and 12 are generally made of steel or the like, the magnetic members 14 provide attraction for preventing disengagement of adjacent two pairs of hairdressing scissors unless a relatively large force is applied to overcome the magnetic attraction and the engaging force between the magnetic members 14 and the peripheries delimiting the first and second grooves 132 and 133.

Figure 3:
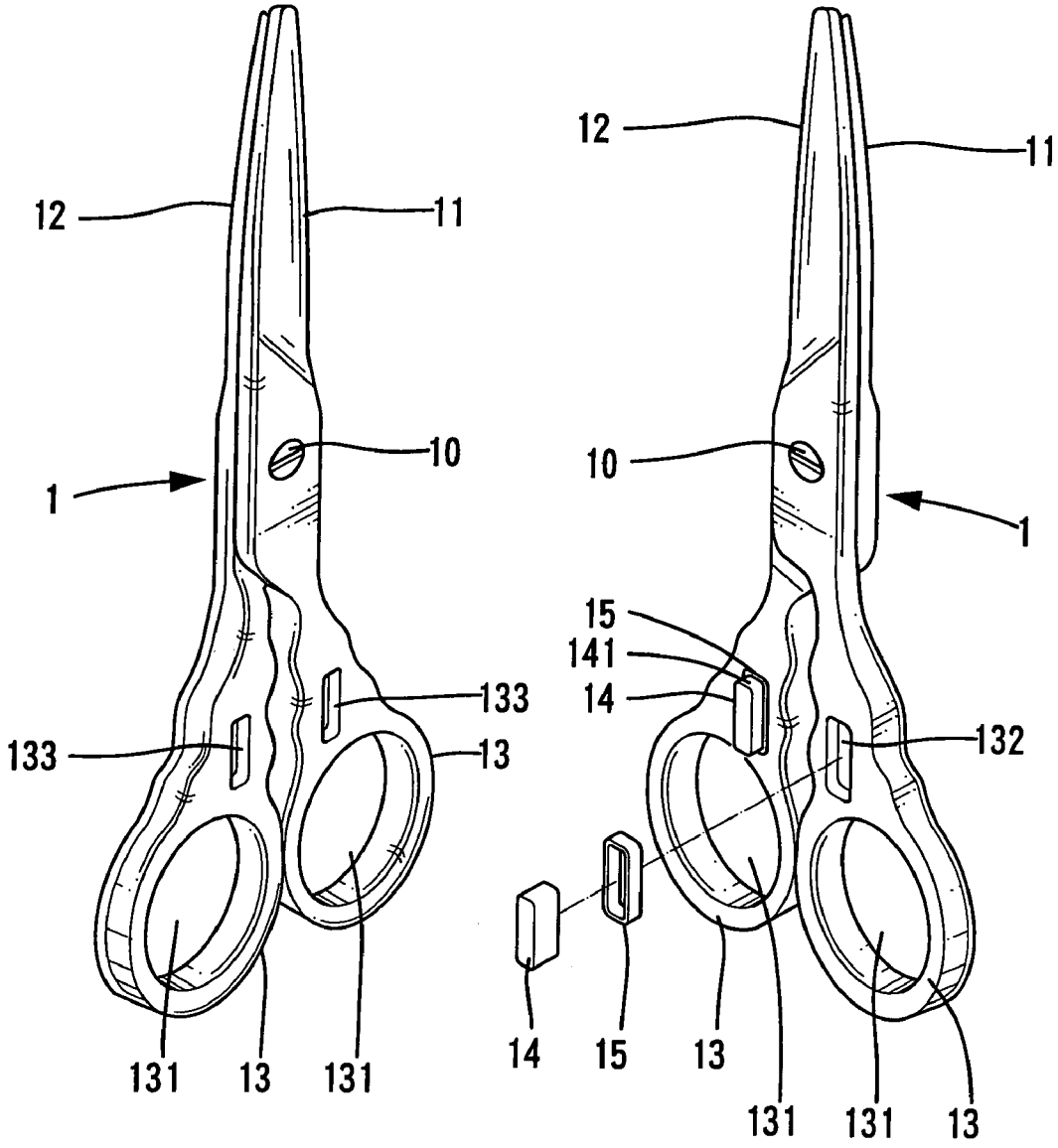
FIG. 3 is a perspective view of two pairs of hairdressing scissors in accordance with a second embodiment of the present invention.

FIG. 3 illustrates a second embodiment of the present invention, wherein a frame ring 15 made of less rigid material is mounted between the respective magnetic member 14 and the periphery delimiting the respective first groove 132. The material of the frame ring 15 is selected to assist in insertion of the respective magnetic member 14 into the respective first groove 132 without adversely affecting magnetic attraction provided by the magnetic member 14.

Figure 4:
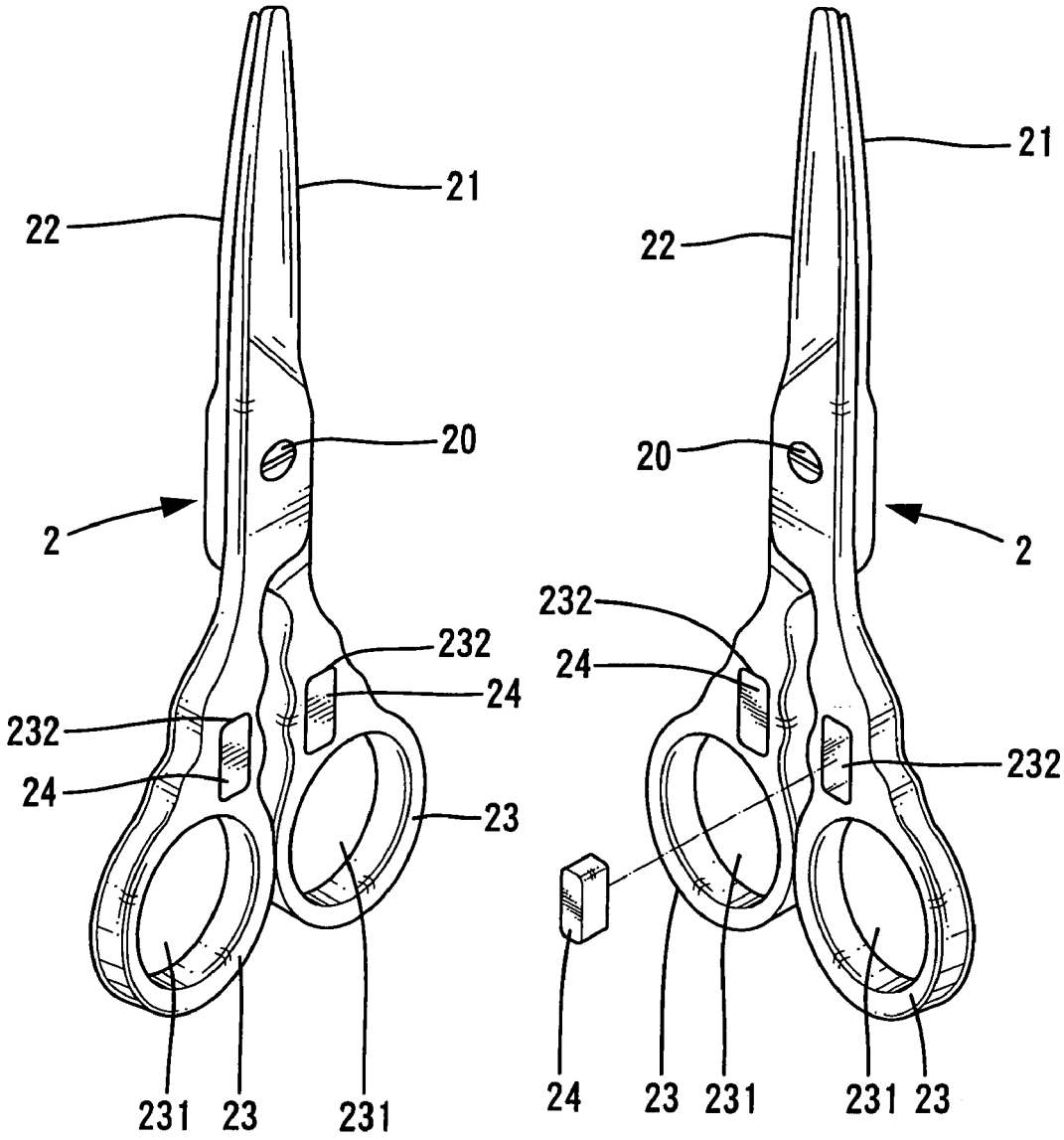
FIG. 4 is a perspective view of two pairs of hairdressing scissors in accordance with a third embodiment of the present invention.

FIG. 4 illustrates a third embodiment of the present invention. More particularly, a pair of hairdressing scissors 2 in accordance with the third embodiment of the present invention generally comprises two cutting members 21 and 22 that are pivoted together by a pivot 20. Each cutting member 21, 22 includes a handle 23 on an end thereof and a blade (not labeled) on the other end thereof, with each handle 23 having an opening 231 for the thumb or index finger of the user.

Each handle 23 has a through-hole 232 in which a magnetic member 24 is securely mounted. The respective magnetic member 24 has a thickness equal to a depth of the respective through-hole 232. Thus, two pairs of hairdressing scissors 2 can be easily connected together through mutual attraction of the magnetic members 24 respectively of the two pairs of hairdressing scissors 2. Detachment of the two pairs of hairdressing scissors 2 can be easily accomplished by applying a force sufficiently large to overcome the magnetic attraction between the magnetic members 24. Thus, the user may combine plural pairs of hairdressing scissors according to need.

Figure 5:
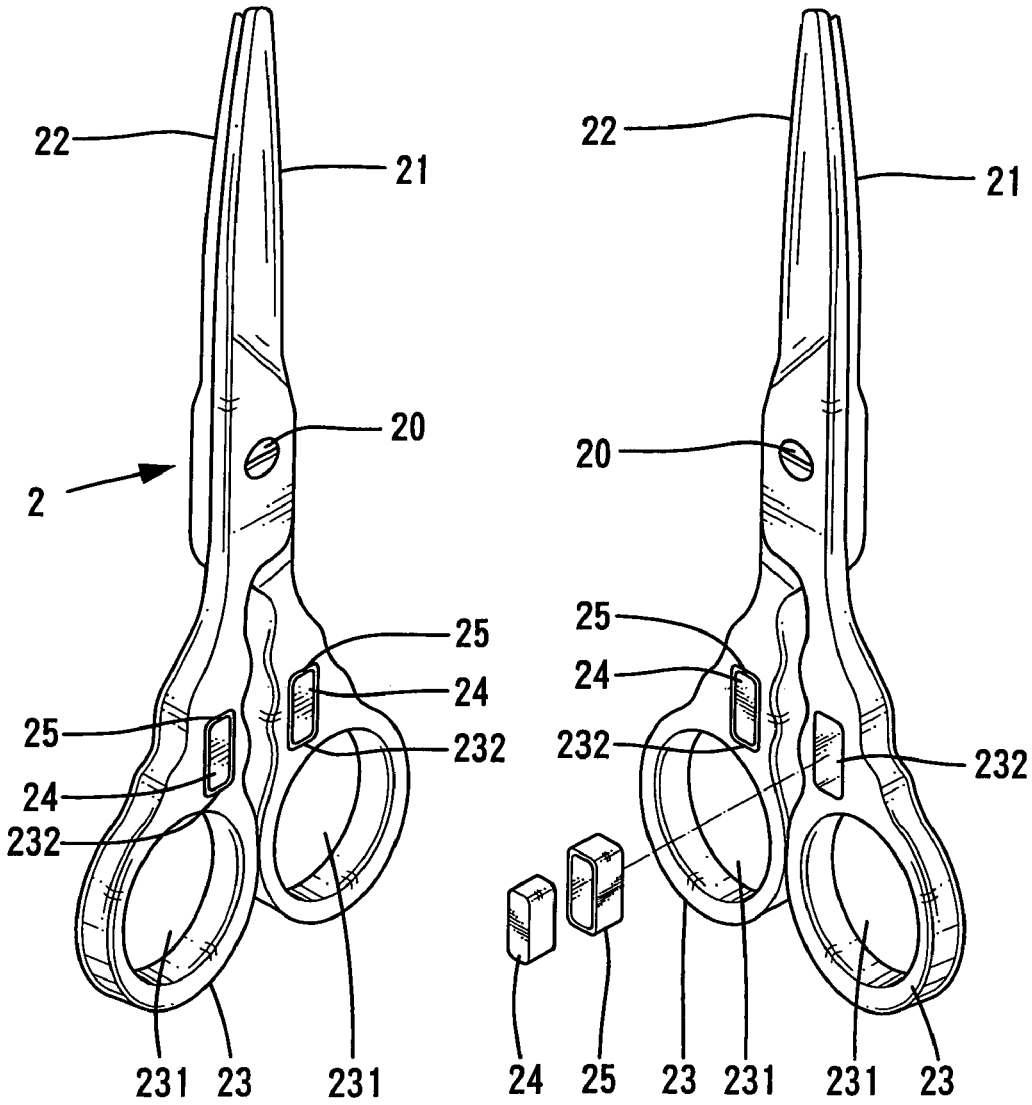
FIG. 5 is a perspective view of two pairs of hairdressing scissors in accordance with a fourth embodiment of the present invention.
Figure 6:
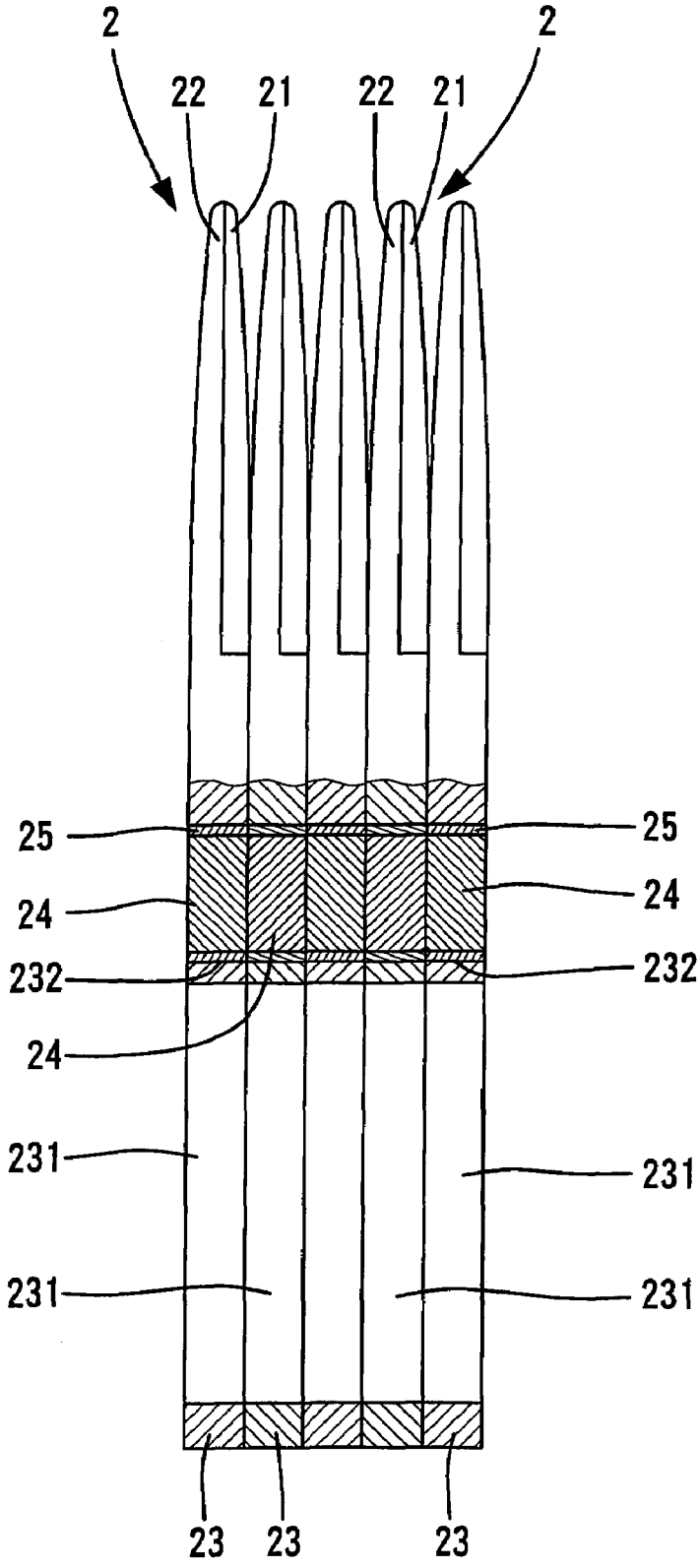
FIG. 6 is a side view, partly sectioned, of plural pairs of hairdressing scissors in accordance with the fourth embodiment of the present invention.

FIG. 5 illustrates a fourth embodiment of the present invention, wherein a frame ring 25 made of less rigid material is mounted between the respective magnetic member 24 and the periphery delimiting the respective through-hole 232. The material of the frame ring 25 is selected to assist in insertion of the respective magnetic member 24 into the respective through-hole 232 without adversely affecting magnetic attraction provided by the magnetic members 24. FIG. 6 illustrates connection of plural pairs of hairdressing scissors in FIG. 5.

Figure 7:
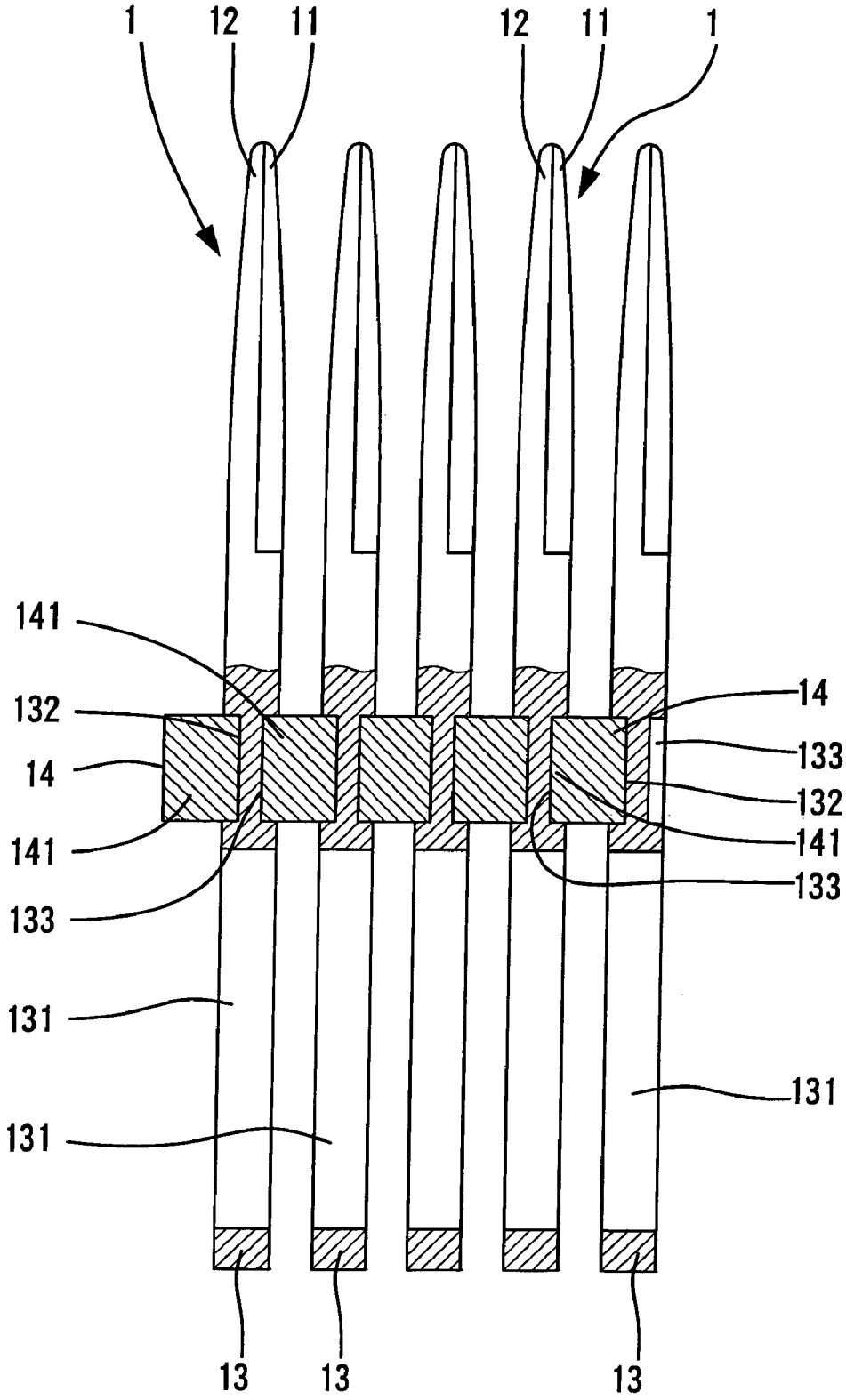
FIG. 7 is a side view, partly sectioned, of plural pairs of hairdressing scissors in accordance with a fifth embodiment of the present invention.

FIG. 7 illustrates a fifth embodiment of the present invention that is modified from the first embodiment shown in FIGS. 1 and 2. In this embodiment, the thickness of the respective magnetic member 14 is greater than the sum of the depth of the first groove 132 and the depth of the second groove 133 so that two adjacent pairs of hairdressing scissors 1 are spaced apart from each other. Thus, the overall hairdressing scissor assembly consisting of plural pairs of the hairdressing scissors can be used to perform special cutting techniques. The spacing between two adjacent pairs of hairdressing scissors 1 can be altered according to need. Alternatively, the spacing may not be uniform throughout the hairdressing assembly. For example, the spacing between the first pair of hairdressing scissors 1 and the second pair of hairdressing scissors can be different from that between the second pair of hairdressing scissors and the third pair of hairdressing scissors.

Figure 8:
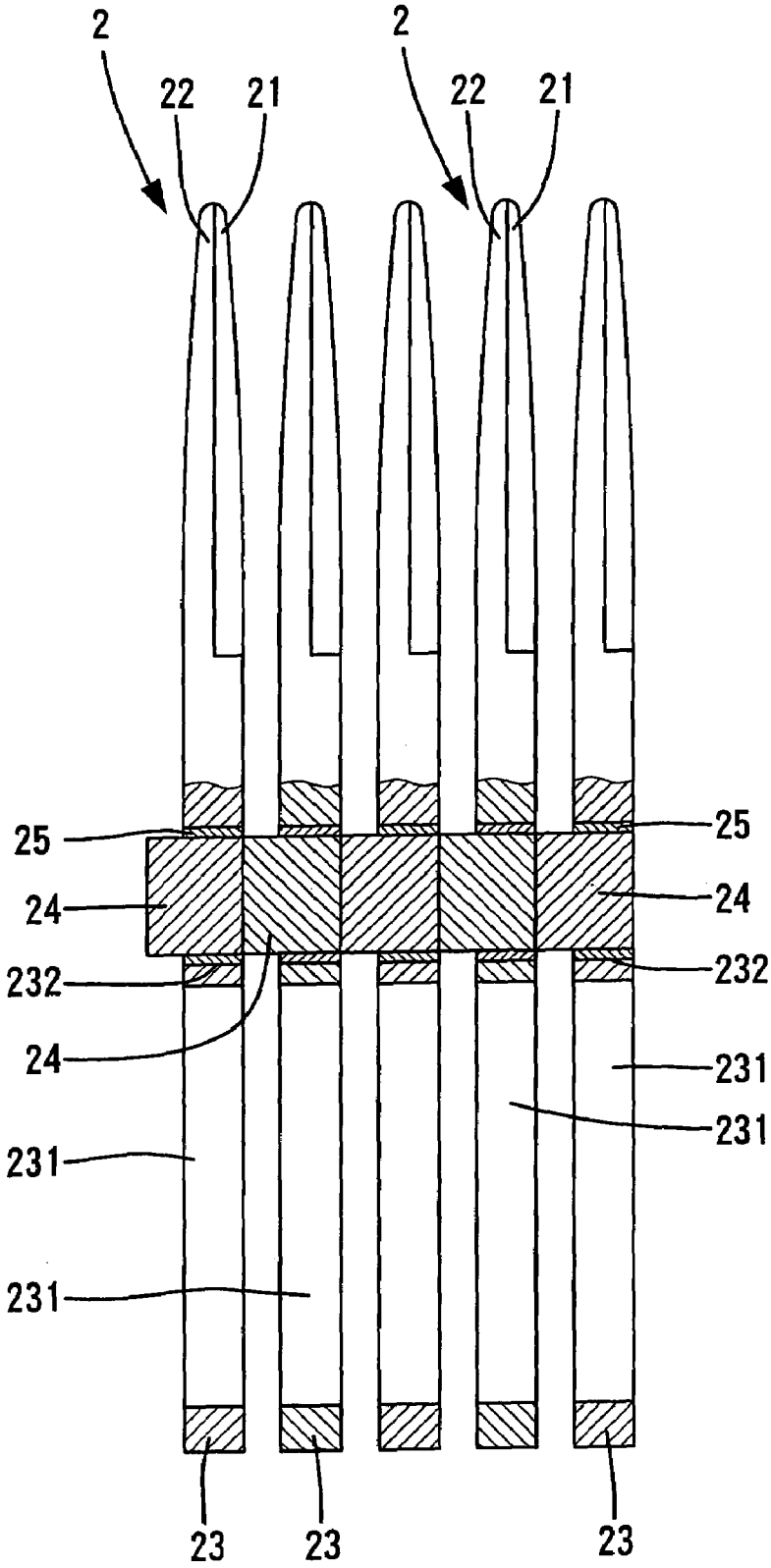
FIG. 8 is a side view, partly sectioned, of plural pairs of hairdressing scissors in accordance with a sixth embodiment of the present invention.

FIG. 8 illustrates a sixth embodiment of the present invention, wherein the respective magnetic member 24 has a thickness greater than the depth of the respective through-hole 232 without adversely affecting its function.

Although the invention has been explained in relation to its preferred embodiment, it is to be understood that many other possible modifications and variations can be made without departing from the scope of the invention as hereinafter claimed.

What is claimed is:

1. A pair of hairdressing scissors comprising two cutting members pivotally connected together about a pivot axis, each said cutting member including a handle having a through-hole extending from a first side thereof through a second side thereof, with the through-hole extending substantially parallel to the pivot axis, a magnetic member being mounted in each said through-hole such that the magnetic member faces in a direction substantially parallel to the pivot axis, said magnetic members of the pair of hairdressing scissors being adapted to attract magnetic members of a pair of similarly constructed hairdressing scissors, thereby connecting the pair of hairdressing scissors and said pair of similarly constructed hairdressing scissors together.

2. The pair of hairdressing scissors as claimed in claim 1, wherein said magnetic member has a thickness equal to a depth of the respective through-hole.

3. The pair of hairdressing scissors as claimed in claim 1, wherein said magnetic member has a thickness greater than a depth of the respective through-hole.

4. The pair of hairdressing scissors as claimed in claim 1, further including a frame ring mounted between each said magnetic member and a periphery delimiting the respective through-hole.

5. A pair of hairdressing scissors comprising two cutting members pivotally connected together about a pivot axis, each said cutting member including a handle, at least one of the handles having a through-hole extending from a first side thereof through a second side thereof, with the through-hole extending substantially parallel to the pivot axis, a magnetic member being mounted in said through-hole such that the magnetic member faces in a direction substantially parallel to the pivot axis, said magnetic member of the pair of hairdressing scissors being adapted to attract a magnetic member of a pair of similarly constructed hairdressing scissors, thereby connecting the pair of hairdressing scissors and said pair of similarly constructed hairdressing scissors together.

6. The pair of hairdressing scissors as claimed in claim 5, wherein said magnetic member has a thickness equal to a depth of the through-hole.

7. The pair of hairdressing scissors as claimed in claim 5, wherein said magnetic member has a thickness greater than a depth of the through-hole.

8. The pair of hairdressing scissors as claimed in claim 5, further including a frame ring mounted between said magnetic member and a periphery delimiting the through-hole.

9. A hairdressing scissor assembly comprising a plurality of pairs of hairdressing scissors, each said pair of hairdressing scissors comprising two cutting members pivotally connected together about a pivot axis, each said cutting member including a handle, at least one of the handles having a through-hole extending from a first side thereof through a second side thereof, with the through-hole extending substantially parallel to the pivot axis, a magnetic member being mounted in said through-hole such that the magnetic member faces in a direction substantially parallel to the pivot axis, said magnetic member of the pair of hairdressing scissors attracting the magnetic member of another pair of the hairdressing scissors, thereby connecting the plurality of pairs of hairdressing scissors.

10. The hairdressing scissor assembly as claimed in claim 9, wherein each said magnetic member has a thickness equal to a depth of an associated one of the through-holes.

11. The hairdressing scissor assembly as claimed in claim 9, wherein each said magnetic member has a thickness greater than a depth of an associated one of the through-holes.

12. The hairdressing scissor assembly as claimed in claim 9, further including a frame ring mounted between each said magnetic member and a periphery delimiting an associated one of the through-holes.

* * * * *